US008114486B2

(12) United States Patent
Nelli

(10) Patent No.: US 8,114,486 B2
(45) **Date of Patent: *Feb. 14, 2012**

(54) COLORED PAPER AND SUBSTRATES COATED FOR ENHANCED PRINTING PERFORMANCE

(75) Inventor: Leo M. Nelli, Piscataway, NJ (US)

(73) Assignee: Evonik Degussa Corporation, Parsippany, NJ (US)

( * ) Notice: Subject to any disclaimer, the term of this patent is extended or adjusted under 35 U.S.C. 154(b) by 416 days.

This patent is subject to a terminal disclaimer.

(21) Appl. No.: 11/679,655

(22) Filed: Feb. 27, 2007

(65) Prior Publication Data

US 2007/0202281 A1 Aug. 30, 2007

Related U.S. Application Data

(60) Provisional application No. 60/777,394, filed on Feb. 28, 2006.

(51) Int. Cl.
*B41M 5/00* (2006.01)

(52) U.S. Cl. ..... 428/32.21; 428/32.28; 428/32.3; 428/32.31; 428/32.34; 427/243

(58) Field of Classification Search ..... 428/32.21, 428/32.28, 32.3, 32.31, 32.34; 427/243
See application file for complete search history.

(56) References Cited

U.S. PATENT DOCUMENTS

| | | | | |
|---|---|---|---|---|
| 5,439,707 | A | 8/1995 | Nelli et al. | |
| 5,562,994 | A | 10/1996 | Abba et al. | |
| 5,605,725 | A | 2/1997 | Macaulay et al. | |
| 5,612,281 | A * | 3/1997 | Kobayashi et al. | 428/32.11 |
| 5,756,226 | A | 5/1998 | Valentini et al. | |
| 5,827,363 | A | 10/1998 | Darsillo et al. | |
| 5,958,168 | A | 9/1999 | Liu et al. | |
| 5,985,424 | A | 11/1999 | DeMatte et al. | |
| 5,997,625 | A | 12/1999 | Londo et al. | |
| 6,203,899 | B1 | 3/2001 | Hirose et al. | |
| 6,270,837 | B1 | 8/2001 | Liu et al. | |
| 6,277,183 | B1 | 8/2001 | Johnson et al. | |
| 6,284,819 | B1 | 9/2001 | Darsillo et al. | |
| 6,365,264 | B2 | 4/2002 | Darsillo et al. | |
| 6,403,162 | B1 | 6/2002 | Tokunaga et al. | |
| 6,417,264 | B1 | 7/2002 | Kono et al. | |
| 6,419,356 | B1 | 7/2002 | Sadasivan et al. | |
| 6,420,039 | B1 | 7/2002 | Field et al. | |
| 6,443,570 | B1 | 9/2002 | Chu et al. | |
| 6,447,110 | B1 | 9/2002 | Chu et al. | |
| 6,447,111 | B1 | 9/2002 | Gallo et al. | |
| 6,457,825 | B1 | 10/2002 | Genick, II | |
| 6,479,135 | B2 | 11/2002 | Bermel et al. | |
| 6,482,883 | B1 | 11/2002 | Cuch et al. | |
| 6,514,601 | B1 | 2/2003 | Sadasivan et al. | |
| 6,527,388 | B1 | 3/2003 | Wang et al. | |
| 6,547,386 | B2 | 4/2003 | Bermel et al. | |
| 6,551,695 | B2 | 4/2003 | Kaneko et al. | |
| 6,551,698 | B1 | 4/2003 | Martin et al. | |
| 6,579,598 | B2 | 6/2003 | Tokunaga et al. | |
| 6,589,635 | B2 | 7/2003 | Suzuki et al. | |
| 6,607,269 | B2 | 8/2003 | Sumioka et al. | |
| 6,610,389 | B2 | 8/2003 | Ishimaru et al. | |
| 6,613,416 | B1 | 9/2003 | Ashida et al. | |
| 6,613,418 | B2 | 9/2003 | Tachikawa et al. | |
| 6,634,743 | B2 | 10/2003 | Perchak et al. | |
| 6,641,875 | B2 | 11/2003 | Sadasivan et al. | |
| 6,645,582 | B2 | 11/2003 | Sadasivan et al. | |
| 6,677,005 | B2 | 1/2004 | Kaneko et al. | |
| 6,677,389 | B2 | 1/2004 | Fukuda et al. | |
| 6,680,109 | B1 | 1/2004 | Plambeck-Fischer et al. | |
| 6,689,430 | B2 | 2/2004 | Sadasivan et al. | |
| 6,689,432 | B2 | 2/2004 | Kitamura et al. | |
| 6,770,336 | B2 | 8/2004 | Wang et al. | |
| 6,773,771 | B1 | 8/2004 | Ashida et al. | |
| 6,808,769 | B2 | 10/2004 | Batz-Sohn et al. | |
| 6,821,585 | B2 | 11/2004 | Sumioka et al. | |
| 6,838,136 | B2 | 1/2005 | Hahn et al. | |
| 6,840,992 | B2 | 1/2005 | Glaum et al. | |
| 6,846,526 | B2 | 1/2005 | Bermel et al. | |
| 6,861,115 | B2 | 3/2005 | Morris et al. | |
| 6,863,775 | B2 | 3/2005 | Bobsein et al. | |
| 6,880,928 | B2 | 4/2005 | Hosoi et al. | |
| 6,899,930 | B2 | 5/2005 | Kiyama et al. | |
| 6,908,191 | B2 | 6/2005 | Liu et al. | |
| 6,921,562 | B2 | 7/2005 | Yip et al. | |
| 6,945,647 | B2 | 9/2005 | Yip et al. | |
| 6,951,671 | B2 | 10/2005 | Mukherjee et al. | |

(Continued)

FOREIGN PATENT DOCUMENTS

CA 2285792 4/2000

(Continued)

OTHER PUBLICATIONS

Kraft process—Wikipedia, the free encyclopedia.* Brunauer, S. et al., "Adsorption of gases in multimolecular layers," J. Am. Chem. Soc. (1938) 60:309-319.
International Search Report and Written Opinion for Application No. PCT/US2007/062888 dated Nov. 27, 2007 (15 pages).
International Search Report and Written Opinion for application No. PCT/US2007/065601 dated Oct. 31, 2007 (10 pages).
United States Patent Office Action for U.S. Appl. No. 11/693,942 dated May 12, 2010 (10 pages).
United States Patent Office Action for U.S. Appl. No. 11/693,942 dated Oct. 19, 2010 (11 pages).
Chinese Patent Office Action for Application No. 200780005371.7 received on Sep. 14, 2010 (6 pages).
Japanese Patent Office Action for Application No. 2008-557465 dated Sep. 3, 2010 (11 pages).
Japanese Patent Office Action for Application No. 2009-530480 drafted on Feb. 22, 2011 (9 pages).
United States Patent Office Action for U.S. Appl. No. 11/693,942 dated Sep. 13, 2011 (9 pages).
Canadian Patent Office Action for Application No. 2,643,858 dated Oct. 5, 2011 (2 pages).
European Patent Office Action for Application No. 07757559.5 dated Nov. 25, 2011 (4 pages).

*Primary Examiner* — Betelhem Shewareged
(74) *Attorney, Agent, or Firm* — Michael Best & Friedrich LLP

(57) ABSTRACT

Coated substrates are made from colored paper coated with a coating comprising silica or fumed metal oxide, such as precipitated silica, colloidal silica, fumed silica or fumed metal oxide. An opaque coating is formed which improves the L* and b* values of the colored paper. Images printed onto the paper show improved characteristics, such as a reduction in wick or bleed, or an improved color gamut.

31 Claims, 4 Drawing Sheets

U.S. PATENT DOCUMENTS

| | | | | |
|---|---|---|---|---|
| 6,964,992 | B2 | 11/2005 | Morris et al. | |
| 6,991,330 | B2 | 1/2006 | Maekawa | |
| 6,994,834 | B1 | 2/2006 | Shirono et al. | |
| 7,015,270 | B2 | 3/2006 | Scharfe et al. | |
| 2001/0004487 | A1 * | 6/2001 | Kaneko et al. | 428/195 |
| 2002/0041952 | A1 | 4/2002 | Murota et al. | |
| 2003/0095905 | A1 | 5/2003 | Scharfe et al. | |
| 2003/0185739 | A1 | 10/2003 | Mangold et al. | |
| 2003/0186003 | A1 * | 10/2003 | Nakano et al. | 428/32.1 |
| 2004/0106697 | A1 | 6/2004 | Lortz et al. | |
| 2004/0253394 | A1 * | 12/2004 | Ebisawa et al. | 428/32.24 |
| 2005/0008794 | A1 | 1/2005 | Graczyk et al. | |
| 2005/0142305 | A1 | 6/2005 | Kobayashi et al. | |
| 2005/0191443 | A1 | 9/2005 | Sunagawa et al. | |
| 2005/0260428 | A1 * | 11/2005 | Song et al. | 428/537.5 |
| 2006/0154994 | A1 | 7/2006 | Schumacher et al. | |
| 2006/0235129 | A1 | 10/2006 | Weigl et al. | |

FOREIGN PATENT DOCUMENTS

| | | |
|---|---|---|
| EP | 0507998 | 10/1992 |
| EP | 0 813 978 A1 * | 12/1997 |
| EP | 1083151 | 3/2001 |
| EP | 1331254 | 7/2003 |
| EP | 1586447 | 10/2005 |
| EP | 1609609 | 12/2005 |
| EP | 1806236 | 7/2007 |
| GB | 898614 | 6/1962 |
| GB | 2343196 | 5/2000 |
| GB | 2353038 | 2/2001 |
| JP | 2-113986 | 4/1990 |
| JP | 5-132898 | 5/1993 |
| JP | 9-099631 | 4/1997 |
| JP | 2000-118124 | 4/2000 |
| JP | 2000-142781 | 5/2000 |
| JP | 2001-096892 | 4/2001 |
| JP | 2001-219648 | 8/2001 |
| JP | 2001-347750 | 12/2001 |
| JP | 2005-178189 | 7/2005 |
| JP | 2005-254656 | 9/2005 |
| JP | 2005-313437 | 11/2005 |
| WO | WO 97/22670 | 6/1997 |
| WO | 00/02734 | 1/2000 |
| WO | 03/002342 | 1/2003 |
| WO | 2004/026766 | 4/2004 |
| WO | WO 2004/050377 | 6/2004 |
| WO | 2004/074576 | 9/2004 |
| WO | WO 2005/061385 | 7/2005 |
| WO | 2006/049546 | 5/2006 |
| WO | WO 2006/067127 | 6/2006 |
| WO | WO 2006/067131 | 6/2006 |

* cited by examiner

A.

B.

A.

B.

A.

B.

COLORED PAPER AND SUBSTRATES COATED FOR ENHANCED PRINTING PERFORMANCE

CROSS-REFERENCE TO RELATED APPLICATIONS

This application claims priority to U.S. Provisional Patent Application Ser. No. 60/777,394, filed on Feb. 28, 2006, the entire contents of which are hereby incorporated by reference.

BACKGROUND OF THE INVENTION

Substrates having improved printing properties are desirable in the art.

SUMMARY

In one aspect, the invention may provide a coated substrate comprising a colored paper coated with a coating comprising silica.

In another aspect, the invention may provide a coated substrate comprising a colored paper coated with a fumed metal oxide.

In another aspect, the invention may provide a method of making a coated substrate by applying a composition to a colored paper. The composition may comprise a fumed metal oxide dispersion or a silica dispersion.

DETAILED DESCRIPTION

Figure 1:
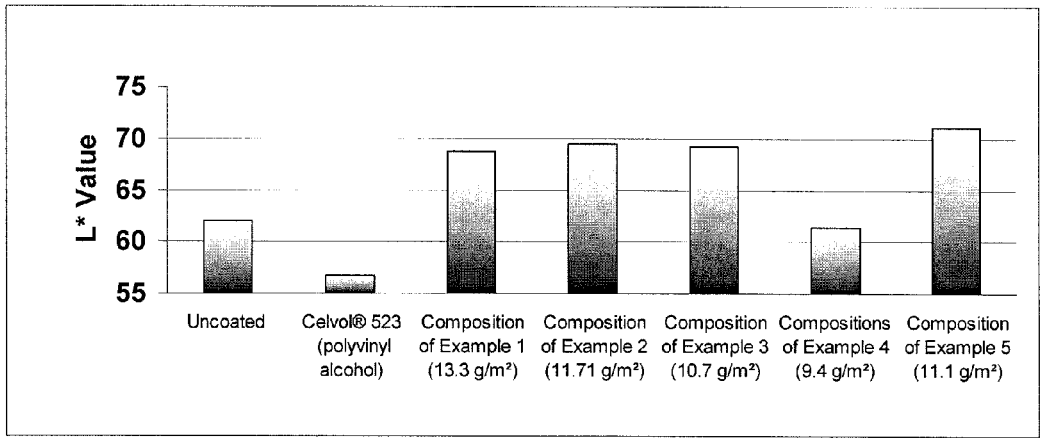
FIGS. 1A and 1B are graphical representations depicting the L* and b* values of kraft paper coated with various compositions comprising silica.
Figure 1:
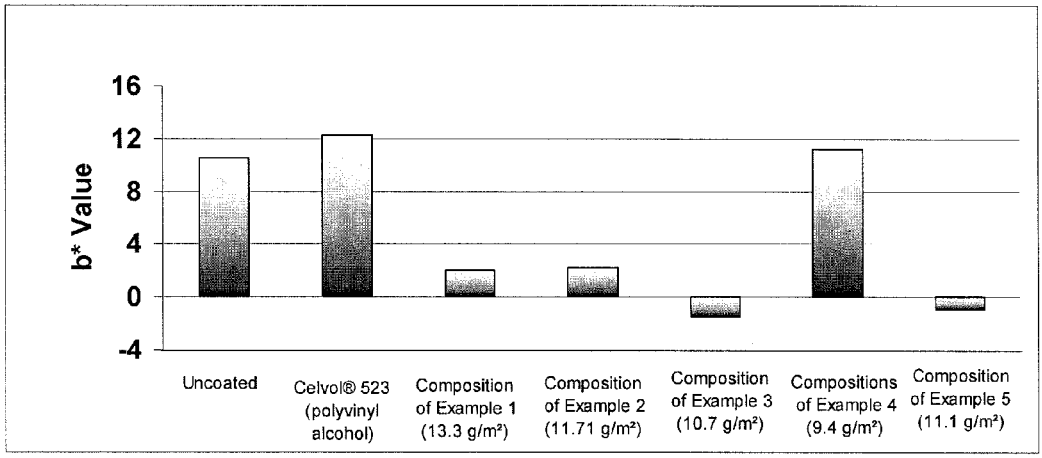

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any nonclaimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In one aspect, the invention provides a substrate coated with a coating composition comprising silica. The silica may comprise at least one of fumed silica particles, precipitated silica particles, gel silica particles, and combinations thereof. The composition may further comprise a dispersing medium for the particles, such as water, a binder or a combination thereof. The composition may be used to coat a substrate to enhance the printing, such as ink jet printing, characteristics of the substrate.

Fumed silica particles, can be produced by pyrogenic processes and have the chemical composition $SiO_2$. Fumed silica particles, typically, are aggregate particles of smaller primary particles, which are held together by relatively strong cohesive forces, such that the aggregate particles are not broken down into primary particles when dispersed in a liquid medium. Aggregate fumed silica particles may also form larger agglomerate particles, which are held together by relatively weak cohesive forces. Agglomerate particles may be broken down into aggregate particles when dispersed in a liquid medium. Suitable fumed silica particles for use in the present invention have an aggregate particle size of at least about 50, and more particularly, at least about 60, at least about 70, at least about 75, at least about 80, at least about 90 or at least about 95 nm. The aggregate particle size is generally less than about 400, and more particularly, less than about 350, less than about 300, less than about 275, less than about 250, less than about 225, less than about 200, or less than about 190 nm.

The coating compositions may comprise fumed metal oxides, silica or dispersions comprising the same. Commercially available fumed silicas suitable for use in the invention include, but are not limited to, those sold under the trademark AERODISP® (Degussa). Suitably, the fumed metal oxide in the dispersion may be doped with a different fumed metal oxide, for example fumed silica doped with fumed alumina. Suitable dispersions include, but are not limited to, AERODISP® WK 341 (a cationized silica dispersion), VP Disp WK 7330 (a cationized fumed mixed metal oxide dispersion—fumed silica doped with fumed alumina), AERODISP® WK 7520, AERODISP® G 1220, AERODISP® W1450, AERODISP® W7215S, AERODISP® W 1226, AERODISP® W 1714, AERODISP® W 1824, AERODISP® W 1836, AERODISP® W 630, AERODISP® W440, VP DISP W7330N, VP DISP W740X, VP DISP 2730, VP DISP 2550, AERODISP® W 7215 S, AERODISP® W 7512 S, AERODISP® W 7520, AERODISP® W 7520 N, AERODISP® W7520P, AERODISP® W 7622, AERODISP® WK 341, and VP DISP W340; those commercially available from Cabot Corporation, such as CAB-O-SPERSE® PG 022, CAB-O-SPERSE® A 2012, CAB-O-SPERSE® 2012A, CAB-O-SPERSE® 2020K, CAB-O-SPERSE® A 2017, CAB-O-SPERSE® 2017A, CAB-O-SPERSE® 1030K, CAB-O-SPERSE® K 2020, CAB-O-SPERSE® 2020K, CAB-O-SPERSE® 4012K, CAB-O-SPERSE® PG 002CAB-O-SPERSE® PG 001, CAB-O-SPERSE® 1015A, CAB-O-SPERSE® 1020K, CAB-O-SPERSE® GP 32/12, CAB-O-SPERSE® GP 32/17, CAB-O-SPERSE® GP 50, CAB-O-SPERSE® MT 32/17, CAB-O-SPERSE® A 105, CAB-O-SPERSE® A 1095, CAB-O-SPERSE® A 205, CAB-O-SPERSE® A 1695, CAB-O-SPERSE® A 2095, CAB-O-SPERSE® C1030K, CAB-O-SPERSE® C1015A, CAB-O-SPERSE® K 4012, CAB-O-SPERSE® P 1010, CAB-O-SPERSE® II, CAB-O-SPERSE® A 3875, CAB-O-SPERSE® PG 001, CAB-O-SPERSE® PG 002 and CAB-O-SPERSE® CT 302C; and those commercially available from Wacker Chemie AG, such as, HDK® XK20030, HDK® A2012, HDK® 1515B, HDK® 2012B, HDK® A3017 and HDK® A3017B; and combinations thereof.

Suitable metal oxides and silicas and dispersions comprising the same are disclosed in United States Patent Application Publication Nos. US2006154994, US20040106697, US2003095905, US2002041952, International Publication Nos. WO2006067131, WO2006067127, WO2005061385, WO2004050377, WO9722670, Canadian Application No. CA2285792, and U.S. Pat. Nos. 7,015,270, 6,808,769, 6,840,992, 6,680,109 and 5,827,363, each of which is hereby fully incorporated by reference.

Other suitable metal oxides and silicas and dispersions comprising the same include, but are not limited to, those commercially available from Akzo Nobel/EKA Chemicals, such as BINDZIL® 15/500, BINDZIL® 30/360, BINDZIL® 30/220, BINDZIL® 305, BINDZIL® 30NH2/220, BINDZIL® 40/220, BINDZIL® 40/170, BINDZIL® 30/80, BINDZIL® CAT 80, BINDZIL® F 45, BINDZIL® 50/80, NYACOL® 215, NYACOL® 830, NYACOL® 1430, NYACOL® 1440, NYACOL® 2034DI, NYACOL® 2040, NYACOL® 2040NH4 and NYACOL® 9950; those commercially available from H.C. Stark/Bayer, such as LEVASIL® 500/15%, LEVASIL® 300/30%, LEVASIL® 300F/30%, LEVASIL® 200E/20%, LEVASIL® 200S/30%, LEVASIL® 200A/30%, LEVASIL® 200/30%, LEVASIL® 200N/30%, LEVASIL® 200/40%, LEVASIL® 100/45%, LEVASIL® 100S/30%, LEVASIL® 100/30%, LEVASIL® 50 CK 30, LEVASIL® 4063, LEVASIL® 100S/45%, LEVASIL® 50/50%; those commercially available from Grace Davison, such as LUDOX® SM, LUDOX® HS-30, LUDOX® LS, LUDOX® HS-40, LUDOX® AM, LUDOX® WP, LUDOX® AS, LUDOX® TM; those commercially available from Nalco Chemical, such as NALCO® 1115, NALCO® 2326, NALCO® 6011, NALCO® 1130, NALCO® 1030, NALCO® 6010, NALCO® 1140, NALCO® 2325, NALCO® 2327, NALCO® 1060, NALCO® 1034, NALCO® 1129, NALCO® 1050, NALCO® 6009; those commercially available from Nissan Chemical Industries Ltd., such as SNOWTEX® 20, SNOWTEX® 30, SNOWTEX® C, SNOWTEX® N, SNOWTEX® O; and those commercially available from Clariant/Rodel, such as KLEBOSOL® 30N25, KLEBOSOL® 30H25, KLEBOSOL® 30N50PHN, KLEBOSOL® 30N50, KLEBOSOL® 30H50, KLEBOSOL® 1501-50, KLEBOSOL® 1508-50, KLEBOSOL® 1498-50. The coating compositions may comprise any of these metal oxides, dispersions comprising metal oxides or combinations thereof.

The surface area of most metal oxide particles can be determined by the method of S. Brunauer, P. H. Emmet, and I. Teller, J. Am. Chemical Society, 60, 309 (1938), which is commonly referred to as the BET method. The fumed silica or fumed metal oxide particles suitable for use in the invention have a BET surface area of at least about 50, or at least about 70 $m^2/g$, and less than about 400, less than about 350 or less than about 325 $m^2/g$. In some embodiments, the fumed silica particles have a BET surface area of about 90 $m^2/g$, about 200 $m^2/g$ or about 300 $m^2/g$.

Gel silica and precipitated silica are formed by "wet chemistry" processes. Like fumed silica, both gel silica and precipitated silica form a three-dimensional network of particles or aggregates. The increased surface area provided by this three-dimensional network permits gel silica and precipitated silica, when used to coat a surface, to immobilize liquid in inks printed onto the surface, allowing for sharper images and a faster ink drying time. Gel and precipitated silicas are therefore suitable for use in the coating compositions.

Colloidal silica particles are generally produced by "wet chemistry" processes and also have the chemical composition $SiO_2$. Typically, colloidal silica is produced by the addition of an acid to an alkaline metal silicate solution (e.g., sodium silicate solution), thereby causing the silicate to polymerize and form discrete particles of amorphous silica. Colloidal silica particles, typically, are discrete, substantially spherical silica particles having no internal surface area. Commercially available colloidal silicas include, but are not limited to, those sold under the trademarks LUDOX® (Grace Davison), BINDZIL® (Akzo Nobel), and NYACOL™ (Akzo Nobel).

In one embodiment, the silica or fumed metal oxide is present in an aqueous dispersion before being combined with a binder to form a composition and/or applied to the substrate. The aqueous dispersion may comprise distilled or deionized water. The composition also may comprise any number of suitable water-miscible liquids, such as one or more water-miscible alcohols (e.g., methanol, ethanol, etc.) or ketones (e.g., acetone) in addition to or instead of water.

As used herein, the term "binder" refers to a compound that helps facilitate adherence of the silica or fumed metal oxide particles to the substrate. Any suitable binder(s) can be used in the compositions including water swellable polymers having a hydrophilic functional group such as a hydroxyl and/or amine. Suitably, the binder comprises at least one of cellulose derivatives (e.g. hydroxyethyl cellulose, carboxymethyl cellulose, cellulose esters, cellulose ethers), casein, gelatin, protein, starch (e.g. oxidized, esterified, or other modified types of starch), vinyl polymers (e.g. polyvinyl alcohol, polyvinyl pyrrolidine, polyvinyl acetate, styrene butadiene and derivatives), acrylic polymers (e.g. polymethyl methacrylate, lattices of acrylic polymers, such as acrylate esters, styrene-acrylic esters), polyesters, polycarbonate polymers, polyamides, polyimides, epoxy polymers, phenolic polymers, polyolefins, polyurethanes copolymers thereof, and mixtures thereof. In one embodiment, the binder is polyvinyl alcohol.

A suitable amount of binder in the composition depends on the particular binder and upon the type of silica or fumed metal oxide used. For example, the optimum amount of polyvinyl alcohol in the composition for a particular application may be different from the optimum amount of polyvinyl pyrrolidine in the composition for that application.

The ratio of silica or fumed metal oxide to binder in the composition may also be varied depending upon the application and the desired result. Suitably, the ratio of silica or fumed metal oxide to binder is at least about 0.25:1, at least about 1:1, at least about 3:1, at least about 5:1, at least about 5.5:1, or at least about 6:1 and less than about 100:1, less than about 50:1, less than about 25:1, less than about 15:1, less than about 12:1, less than about 10:1, less than about 7.5:1, or less than about 7:1.

Generally, the compositions may have a viscosity ranging from very low to very high, so long as they are capable of being deposited on to the surface of the substrate using techniques known in the art. Any suitable technique known in the art may be used to measure the viscosity of the compositions. For example, viscosity may be measured using a Brookfield LVT viscometer. Suitably, the viscosity may be at least about 1, at least about 5, at least about 10, at least about 25, at least about 50, or at least about 100 centipoise and less than about 1,000, less than about 1,500, less than about 2,000, less than about 2,500 or less than about 3,000 centipoise.

The composition can be prepared, using a variety of methods. In one embodiment, the composition is prepared by combining an aqueous dispersion of silica or a fumed metal oxide (e.g., an aqueous dispersion comprising fumed silica particles and water) with at least one binder to produce the coating composition. The dispersion and the binder may be combined, for example, by mixing with a high shear mixer. The pH of the coating composition can be adjusted at any stage during its preparation to a desired pH. However, in some embodiments no adjustment of the pH is required. In one embodiment, the pH is directly adjusted on the dispersion when accompanied by high shear mixing. The pH also may be adjusted after the dispersion is mixed with the binder (i.e., after forming the coating composition). An adjustment in pH will usually be accompanied by a rise in viscosity as the dispersion approaches the neutral pH range (6.5-7.5). The pH can be adjusted using any suitable method, such as via the addition of an acid (e.g., mineral acid, acidic cation exchange resin, etc.) or a base (e.g., an alkali metal hydroxide, basic anion exchange resin, etc.). The coating compositions may be acidic or alkaline. Suitably, the pH of the coating compositions may fall within a pH range of about 2.5 to about 10.5; for example a pH range of about 2.5 to about 5 or about 8 to about 10.5.

The composition also can further comprise one or more other additives, such as surfactants (e.g., cationic surfactants, anionic surfactants such as long-chain alkylbenzene sulfonate salts and long-chain, suitably branched-chain, alkylsulfosuccinate esters, nonionic surfactants such as polyalkylene oxide ethers of long-chain, preferably branched-chain alkyl group-containing phenols and polyalkylene oxide ethers of long-chain alkyl alcohols, and fluorinated surfactants), hardeners (e.g., active halogen compounds, vinylsulfone compounds, aziridine compounds, epoxy compounds, acryloyl compounds, isocyanate compounds, etc.), thickeners (e.g., carboxymethyl cellulose (CMC)), flowability improvers, antifoamers (e.g., octyl alcohol, silicone-based antifoamers, etc.), foam inhibitors, releasing agents, foaming agents, penetrants, colorants (e.g. dyes or pigments), pigment dispersants, optical brighteners, whiteners (e.g., fluorescent whiteners), preservatives (e.g., p-hydroxybenzoate ester compounds, benzisothiazolone compounds, isothiazolone compounds, etc.), biocides, antifungal agents, yellowing inhibitors (e.g., sodium hydroxymethanesulfonate, sodium p-toluenesulfinate, etc.), ultraviolet absorbers (e.g., benzotriazole compounds having an hydroxy-dialkylphenyl group at the 2-position), antioxidants (e.g., sterically hindered phenol compounds), antistatic agents, pH regulators (e.g., sodium hydroxide, sodium carbonate, sulfuric acid, hydrochloric acid, phosphoric acid, citric acid, etc.), cross-linking agents, water-resisting agents, wet strengthening agents, dry strengthening agents and lubricants (polyethylene waxes, natural waxes such as carnauba wax, calcium stearate, fatty acids and salts of fatty acids, paraffin).

In addition to these additives, the coating composition also can comprise a mordant, such as a cationic polymer, which may enhance the water-fastness of the composition. The cationic quaternary ($NH_4^+$) functionality of many polymers and salts may facilitate the binding of anionic dyes commonly used in ink jet inks. Suitable mordants include, but are not limited to, poly(vinylbenzyl trimethylammonium chloride), polyamines, poly DADMAC (diallyl dimethyl ammonium chloride), polyethyleneimine (PEI) and mixtures thereof.

Additionally, colorants such as pigments or dyes may be added that may enhance the whiteness of the compositions when applied to a substrate. Suitable pigments include clay (standard grades, calcined grades, delaminated grades, chemically structured grades, composites/specialty grades), titanium dioxide (rutile, anatase), calcium carbonate (ground, precipitated), alumina tri-hydrate and sodium silicates. Calcium carbonate, alumina tri-hydrate and sodium silicates may also enhance the ink jet performance of the composition when coated onto a substrate and enhance anti-slip properties. The presence of silica or fumed metal oxide in the composition, such as fumed silica, may advantageously reduce the amount of agglomeration of these additional pigments.

The invention further provides a recording medium comprising a substrate coated with the composition as described herein (e.g., a composition comprising a binder and an aqueous dispersion comprising fumed silica particles and water) applied to at least a portion of the substrate. The substrate is suitably a paper that can be used as a packaging material, such as colored paper. As used herein, the term "paper" includes, but is not limited to paper, paperboard and cardboard. As used herein, the term "colored paper" means paper that is made from unbleached cellulose fibers, or paper that is made from bleached cellulose fibers, but has had color added such as by incorporating a colorant, such as a dye or pigment, into or onto the paper. "Bleached cellulose fibers" are cellulose fibers that have been treated by contacting the fibers with a bleaching agent, such as chorine-based bleaches (chlorine dioxide, perchlorate) and/or peroxides. In one embodiment, the paper may be made from unbleached cellulose fibers. In another embodiment, the paper is made from bleached cellulose fibers and comprises a colorant, such as a dye or pigment. Suitably, the substrate may be paper used in packaging materials such as boxes, sacks, bags and the like. In one embodiment, the substrate is brown kraft liner paper. Suitable papers include those having a GE brightness of less than about 90%, less than about 88%, less than about 86%, less than about 84%, less than about 82% less than about 80%, less than about 75%, less than about 70%, less than about 65% or less than about 60%, and those having a GE brightness of at least about 5%, at least about 10%, at least about 15%, at least about 20%, at least about 25%, at least about 30%, at least about 35%, at least about 40%, at least about 45%, at least about 50%, or at least about 55%.

The inventor surprisingly and unexpectedly discovered that, in contrast to the transparent or translucent layers formed when silica coatings are applied to photo papers, the application of coating compositions disclosed herein to colored paper caused the paper to have a whiter, brighter surface. Moreover, the compositions produced a uniform opaque layer when applied to the surface of the substrate.

Whiteness of a substrate such as paper can be estimated using an L* value, which is a measure of the total amount of light reflected off the surface of the substrate. A higher L* value correlates with increased whiteness. Suitably, the coating compositions may improve the L* whiteness value of a substrate by at least about 2, at least about 3, at least about 4, at least about 5, at least about 6, at least about 7, at least about 8, at least about 9, or at least about 10. The blue-yellow hue of paper is estimated using b* values. A lower b* value indicates that the substrate has a less yellow and more blue hue. Blue is perceived by the eye as being closer to white, and lower b* values are desirable. The coating compositions may reduce the b* value of the surface. Suitably, the coating compositions reduce the b* value of the substrate by at least about 2, at least about 3, at least about 4, at least about 5, at least about 6, at least about 7, at least about 8, at least about 9, at least about 10, at least about 11 or at least about 12.

The recording medium described herein can be prepared by a method comprising (a) providing a substrate; (b) coating at least a portion of the substrate with the composition described herein (e.g., a composition comprising at least one binder and an aqueous dispersion comprising fumed silica or fumed metal oxide particles) to provide a coated substrate; and (c) optionally drying the composition on the substrate. Furthermore, the composition may be repeatedly applied to the substrate to provide a recording medium having a coating with a desired thickness.

Any suitable method can be used to coat a portion of the substrate, directly or indirectly, with the composition. Suitable methods include, but are not limited to, roll coating, blade coating, air knife coating, rod coating (e.g., using a Meyer rod or the like), bar coating, cast coating, gate roll coating, wire bar coating, short-dowel coating, slide hopper coating, curtain coating, flexographic coating, gravure coating, Komma coating, size press coating in the manner of on- or off-machine, and die coating. Rapid, inexpensive methods such as rod coating and blade coating may be particularly suitable. The coating applied to the substrate can be of any suitable thickness. The coating is suitably applied to provide at least about 0.5, at least about 1, at least about 2, at least about 3, at least about 4, at least about 5, at least about 6, or at least about 7 g silica or fumed metal oxide per $m^2$ of substrate, and less than about 30, less than about 25, less than about 20, less than about 15, less than about 14, less than about 13, less than about 12, less than about 11, less than about 10, less than about 9, or less than about 8 g silica or fumed metal oxide per $m^2$ of substrate. The amount of silica or fumed metal oxide per $m^2$ of substrate, is referred to herein as the "coat weight."

After application of the coating composition to the substrate, the coated substrate can be dried using any suitable method or combination of methods to provide the recording medium. Suitable drying methods include, but are not limited to, air or convection drying (e.g., linear tunnel drying, arch drying, air-loop drying, sine curve air float drying, etc.), contact or conduction drying, and radiant-energy drying (e.g., infrared drying and microwave drying).

An image may be printed, directly or indirectly, onto the recording medium using one or more of a variety of printing techniques, including gravure (flexo, roto), offset litho, electrophotographic, and high speed digital (for example, using XEIKON™ printers or INDIGO™ printers) techniques. The recording medium is particularly suited to receive an image from an ink jet printer. Images made using an ink jet printer on a recording medium comprising the coating compositions are brighter, sharper and have a higher resolution compared with a comparable substrate that has not been coated with the coating compositions. For example, inks ink-jet printed on a substrate coated with a coating composition described herein, compared with inks printed onto a comparable uncoated substrate, may show a reduction in bleeding and wicking of the ink of at least about 5 microns, at least about 10 microns, at least about 15 microns, at least about 20 microns, at least about 25 microns, or about at least 30 microns. Inks ink-jet printed on a substrate coated with a coating composition, compared with inks printed onto a comparable uncoated substrate, may show an improvement in the raggedness of a line ink-jet printed onto the coated surface, such that the amount of line raggedness is reduced by at least about 2 microns, at least about 5 microns, at least about 10 microns, at least about 15 microns, at least about 20 microns, or at least about 25 microns. The brightness of images printed on a substrate coated with the coating compositions described herein may also be improved over a comparable uncoated substrate. For example, the optical density of inks printed onto a substrate coated with a coating composition, compared with inks printed in a comparable manner onto a comparable uncoated substrate, may be raised by at least about 0.05, at least about 0.1, at least about 0.15, at least about 0.2 or at least about 0.25.

The coating compositions may also improve the color gamut of the substrate. The color gamut of a substrate is the number of colors that can be accurately represented under a certain set of conditions. The compositions may improve the color gamut of a substrate by at least about 50%, at least about 75%, at least about 100%, at least about 150%, at least about 200%, at least about 300%, or at least about 400%.

Coating compositions comprising one or more fumed metal oxides or silicas, for example fumed silica, may also improve or enhance the anti-slip properties of the substrate by increasing the coefficient of friction of the substrate. As used herein, the coefficient of friction means the static coefficient of friction. The coefficient of friction can be suitably measured by any technique known in the art. For example, a technique known in the art to measure the static coefficient of friction is a TAPPI method T815 om-01. Suitably, the coating compositions increase the coefficient of friction of the substrate by at least about 0.2, at least about 0.25, at least about 0.3, at least about 0.35, at least about 0.4, at least about 0.45, or at least about 0.5. Suitably, the silica or fumed metal oxide in the coating increases the coefficient of friction of the substrate by at least about 0.2, at least about 0.25, at least about 0.3, at least about 0.35, or at least about 0.4 compared with the same substrate coated with a similar coating not comprising silica or fumed metal oxide.

The following examples further illustrate the invention but should not be construed as in any way limiting its scope.

EXAMPLE 1

Composition Comprising an Alkaline Fumed Silica (Particle Size 100 nm) Dispersion AERODISP® W 7622 (a low viscosity, slightly alkaline, water-based dispersion of AEROSIL® (fumed silica having a particle size of 100 nm and a surface area of 300 $m^2/g$)) was combined with CELVOL® 523 (polyvinyl alcohol) using a DISPERMAT® mixer with a high shear blade at a shear rate of 1200 inverse minutes. The proportions of AERODISP® and CELVOL® 523 were chosen such that the weight ratio of fumed silica to polyvinyl alcohol in the composition was 6.67:1.

EXAMPLE 2

Composition Comprising an Alkaline Fumed Silica (Particle Size 120 nm) Dispersion AERODISP® W 7520 (a low viscosity, slightly alkaline, water-based dispersion of AEROSIL® (fumed silica having a particle size of 120 nm and a surface area of 200 $m^2/g$)) was combined with CELVOL® 523 (polyvinyl alcohol) using a DISPERMAT® mixer with a high shear blade at a shear rate of 1200 inverse minutes. The proportions of AERODISP® and CELVOL® 523 were chosen such that the weight ratio of fumed silica to polyvinyl alcohol in the composition was 6.67:1.

EXAMPLE 3

Composition Comprising an Acidic Fumed Silica (Particle Size 180 nm) Dispersion

AERODISP® W 7215 S (a low viscosity, slightly acidic, water-based dispersion of AEROSIL® (fumed silica having a particle size of 180 nm and a surface area of 90 $m^2/g$)) was combined with CELVOL® 523 (polyvinyl alcohol) using a DISPERMAT® mixer with a high shear blade at a shear rate of 1200 inverse minutes. The proportions of AERODISP® and CELVOL® 523 were chosen such that the weight ratio of fumed silica to polyvinyl alcohol in the composition was 6.67:1.

EXAMPLE 4

Compositions Comprising Colloidal Silica Dispersions

Five different compositions were made by combining CELVOL® 523 (polyvinyl alcohol) with one of the following five colloidal silica dispersions: IJ935 (obtained from Azko Nobel); NYACOL™ 1430 (obtained from Nyacol Nanotechnologies, Inc.), BINDZIL™ 30/60 (obtained from Azko Nobel); LUDOX™ HS40 (obtained from Grace Division); LUDOX™ SM30 (obtained from Grace Division). The proportions of polyvinyl alcohol and colloidal silica were chosen such that the weight ratio of colloidal silica to polyvinyl alcohol in each composition was 6.67:1. The colloidal silica was combined with the polyvinyl alcohol using a DISPERMAT® mixer with a high shear blade, at a shear rate of 1200 inverse minutes

EXAMPLE 5

Composition Comprising a Precipitated Silica Dispersion

SIPERNAT® 22 S, a fine particle precipitated silica with a high absorption capacity for liquids, was combined with CELVOL® 523 (polyvinyl alcohol) using a DISPERMAT® mixer with a high shear blade at a shear rate of 1200 inverse minutes. The proportions of SIPERNAT® 22 S and CELVOL® 523 were chosen such that the weight ratio of precipitated silica to polyvinyl alcohol in the composition was 6.67:1.

EXAMPLE 6

Application of the Composition of Example 1 to Brown Kraft Liner Paper

The composition of Example 1 was used to coat brown kraft liner paper (75#) using a #5 or #15 wire rod, such that the amount of fumed silica dispersed over the surface of the paper was 8.6 $g/m^2$ or 13.3 $g/m^2$. L*, a* and b* values for the coated paper compared with the uncoated paper are presented in Table 1. At 13.3 $g/m^2$, the paper coated with silica had a b* value of 2.05 and an L*value of 68.71, compared with a b* value of 10.55 and an L* value of 61.94 for uncoated paper, and a b* value of 12.23 and an L* value of 56.68 for paper coated with CELVOL® 523 (polyvinyl alcohol) but no silica. The L* and b* values for paper for uncoated paper, paper coated with polyvinyl alcohol but no silica (CELVOL® 523), and the paper coated with 13.3 $g/m^2$ of the composition of Example 1 (W7622) are also represented graphically in FIGS. 1 (A and B).

The lower b* value of the paper coated with fumed silica indicated that the silica coating had imparted a less yellow and more blue hue to the kraft paper. The coated paper was also visually significantly whiter than the uncoated paper. The results for the L*, a* and b* values (measured in triplicate) of the coated paper are shown in Table 1.

TABLE 1

| | Uncoated | | | Coat Wt = 8.6 $g/m^2$ | | | Coat Wt = 13.3 $g/m^2$ | | |
|---|---|---|---|---|---|---|---|---|---|
| L* | 62.48 | 61.50 | 61.85 | 67.44 | 69.92 | 67.82 | 67.25 | 68.53 | 70.35 |
| a* | 7.93 | 8.23 | 7.90 | 6.36 | 5.48 | 6.37 | 5.72 | 5.56 | 5.69 |
| b* | 10.11 | 10.95 | 10.60 | 4.23 | 1.44 | 4.26 | 2.31 | 1.90 | 1.94 |

EXAMPLE 7

Application of the Composition of Example 2 to Brown Kraft Liner Paper

The composition of Example 2 was used to coat brown kraft liner paper, using a #5 or #15 wire rod, such that the amount of fumed silica dispersed over the surface of the paper was 8.0 $g/m^2$ or 11.7 $g/m^2$. The L*, a* and b* values for the coated paper compared with the uncoated paper are presented in Table 2. At 11.7 $g/m^2$, the coated paper had a b* value of 2.22 and an L* value of 69.45, compared with a b* value of 10.55 and an L* value of 61.94 for uncoated paper, and a b* value of 12.23 and an L* value of 56.68 for paper coated with CELVOL® 523 (polyvinyl alcohol) but no silica. The L* and b* values for paper for uncoated paper, paper coated with polyvinyl alcohol but no silica (CELVOL® 523), and the paper coated with 111.7 $g/m^2$ of the composition of Example 2 (W7520) are also represented graphically in FIGS. 1 (A and B).

The lower b* value of the paper coated with fumed silica indicated that the silica coating had imparted a less yellow and more blue hue to the kraft paper. The coated paper was also visually significantly whiter than the uncoated paper. The results for the L*, a* and b* values (measured in triplicate) of the coated paper are shown in Table 2.

TABLE 2

| | Uncoated | | | Coat Wt = 8.0 $g/m^2$ | | | Coat Wt = 11.7 $g/m^2$ | | |
|---|---|---|---|---|---|---|---|---|---|
| L* | 62.48 | 61.50 | 61.85 | 68.27 | 68.92 | 67.55 | 69.37 | 69.74 | 69.24 |
| a* | 7.93 | 8.23 | 7.90 | 6.08 | 6.16 | 5.73 | 5.91 | 5.79 | 5.87 |
| b* | 10.11 | 10.95 | 10.60 | 3.61 | 3.64 | 2.44 | 2.31 | 2.04 | 2.30 |

EXAMPLE 8

Application of the Composition of Example 3 to Brown Kraft Liner Paper

The composition of Example 3 was used to coat brown kraft liner paper, using a #5 or #15 wire rod, such that the amount of fumed silica dispersed over the surface of the paper was 8.5 $g/m^2$ or 10.7 $g/m^2$. The L*, a* and b* values for the coated paper compared with the uncoated paper are presented in Table 3. At 10.7 $g/m^2$, the coated paper had a b* value of 2.05 and an L* value of 68.71, compared with a b* value of 10.55 and an L* value of 61.94 for uncoated paper, and a b* value of 12.23 and an L* value of 56.68 for paper coated with CELVOL® 523 (polyvinyl alcohol) but no silica. The L* and b* values for paper for uncoated paper, paper coated with polyvinyl alcohol but no silica (CELVOL® 523), and the paper coated with 10.7 $g/m^2$ of the composition of Example 3 (W7215 S) are also represented graphically in FIGS. 1 (A and B).

The lower b* value of the paper coated with fumed silica indicated that the silica coating had imparted a less yellow and more blue hue to the kraft paper. The coated paper was also visually significantly whiter than the uncoated paper. The results for the L*, a* and b* values (measured in triplicate) of the coated paper are shown in Table 3.

TABLE 3

| | Uncoated | | | Coat Wt = 8.5 g/m$^2$ | | | Coat Wt = 10.7 g/m$^2$ | | |
|---|---|---|---|---|---|---|---|---|---|
| L* | 62.48 | 61.50 | 61.85 | 67.28 | 68.32 | 74.20 | 68.36 | 70.08 | 69.25 |
| a* | 7.93 | 8.23 | 7.90 | 5.35 | 5.10 | 2.99 | 4.65 | 4.38 | 4.83 |
| b* | 10.11 | 10.95 | 10.60 | −0.16 | −0.62 | −4.29 | −1.27 | −1.98 | −1.32 |

EXAMPLE 9

Application of Compositions of Example 4 to Brown Kraft Liner Paper

The compositions of Example 4 were used to coat brown kraft liner paper using a #5 or #15 wire rod. Values were averaged from paper coated with LUDOX® HS40, LUDOX® SM30 or NYACOL® 1450. The average coat weight of these three coatings was 9.4 g/m$^2$, with an average b* value of 11.23 and an average L* value of 61.36, compared with a b* value of 12.23 and an L* value of 56.68 for paper coated with CELVOL® 523 (polyvinyl alcohol) but no silica, and a b* value of 10.55 and an L* value of 61.94 for uncoated paper.

The colloidal silica compositions did not significantly lower the b* value of the coated paper. The paper coated with colloidal silica also was not visually significantly whiter than the uncoated paper or paper coated with CELVOL® 523 (polyvinyl alcohol) but no silica.

Results of the L*, b* and a* values (measured in triplicate) for paper coated with the compositions of Example 4 comprising IJ935 (obtained from Azko Nobel); NYACOL™ 1430 (obtained from Nyacol Nanotechnologies, Inc.), LUDOX™ HS40 (obtained from Grace Division); or LUDOX™ SM30 (obtained from Grace Division) are presented in Tables 4-7.

TABLE 4

| | Kraft liner paper (75#) coated with CELVOL ® 523 | | | Kraft liner paper (75#) coated with CELVOL ® 523 and IJ935 Coat Wt = 6.09 g/m$^2$ | | |
|---|---|---|---|---|---|---|
| L* | 56.93 | 56.88 | 56.24 | 60.24 | 58.80 | 60.14 |
| a* | 8.54 | 8.12 | 8.45 | 7.51 | 7.75 | 7.73 |
| b* | 12.43 | 11.62 | 12.64 | 9.20 | 10.04 | 9.69 |

TABLE 5

| | Kraft liner paper (75#) coated with CELVOL ® 523 | | | Kraft liner paper (75#) coated with CELVOL ® 523 and NYACOL ™ 1430 Coat Wt = 9.9 g/m$^2$ | | |
|---|---|---|---|---|---|---|
| L* | 56.93 | 56.88 | 56.24 | 61.67 | 62.13 | 62.55 |
| a* | 8.54 | 8.12 | 8.45 | 8.21 | 7.98 | 7.99 |
| b* | 12.43 | 11.62 | 12.64 | 11.38 | 10.72 | 10.40 |

TABLE 6

| | Kraft liner paper (75#) coated with CELVOL ® 523 | | | Kraft liner paper (75#) coated with CELVOL ® 523 and LUDOX ™ HS40 Coat Wt = 6.09 g/m$^2$ | | |
|---|---|---|---|---|---|---|
| L* | 56.93 | 56.88 | 56.24 | 58.83 | 60.14 | 60.57 |
| a* | 8.54 | 8.12 | 8.45 | 8.01 | 8.43 | 8.67 |
| b* | 12.43 | 11.62 | 12.64 | 11.62 | 11.78 | 12.63 |

TABLE 7

| | Kraft liner paper (75#) coated with CELVOL ® 523 | | | Kraft liner paper (75#) coated with CELVOL ® 523 and LUDOX ™ SM30 Coat Wt = 8.08 g/m$^2$ | | |
|---|---|---|---|---|---|---|
| L* | 56.93 | 56.88 | 56.24 | 61.67 | 62.13 | 62.55 |
| a* | 8.54 | 8.12 | 8.45 | 8.21 | 7.98 | 7.99 |
| b* | 12.43 | 11.62 | 12.64 | 11.38 | 10.72 | 10.40 |

The L* and b* values for paper for uncoated paper, paper coated with polyvinyl alcohol but no silica (CELVOL® 523), and the paper coated with 9.4 g/m$^2$ of colloidal silica (values averaged from LUDOX® HS40, LUDOX® SM30, and NYACOL® 1450) are also represented graphically in FIGS. 1 (A and B).

EXAMPLE 10

Application of the Composition of Example 5 to Brown Kraft Liner Paper

The composition of Example 5 was used to coat brown kraft liner paper, using a #15 wire rod, such that the amount of fumed silica dispersed over the surface of the paper was 11.1 g/m$^2$. The L*, a* and b* values for the coated paper compared with the uncoated paper are presented in Table 8. At 11.1 g/m$^2$, the coated paper had a b* value of −0.95 and an L* value of 71.02, compared with a b* value of 10.55 and an L* value of 61.94 for uncoated paper, and a b* value of 12.23 and an L* value of 56.68 for paper coated with CELVOL® 523 (polyvinyl alcohol) but no silica. The L* and b* values for paper for uncoated paper, paper coated with polyvinyl alcohol but no silica (CELVOL® 523), and the paper coated with 11.1 g/m$^2$ of the composition of Example 5 (SIPERNAT® 22 S) are also represented graphically in FIGS. 1 (A and B).

The lower b* value of the paper coated with precipitated silica indicated that the silica coating had imparted a less yellow and more blue hue to the kraft paper. The coated paper was also visually significantly whiter than the uncoated paper. The results for the L*, a* and b* values (measured in triplicate) of the coated paper are shown in Table 8.

TABLE 8

| | uncoated | | | Coat Wt = 11.1 g/m$^2$ | | |
|---|---|---|---|---|---|---|
| L* | 62.48 | 61.50 | 61.85 | 70.80 | 71.05 | 71.22 |
| a* | 7.93 | 8.23 | 7.90 | 5.51 | 5.15 | 5.29 |
| b* | 10.11 | 10.95 | 10.60 | −0.82 | −1.06 | −0.97 |

EXAMPLE 11

Images Printed on Uncoated Kraft Liner Paper

Ink (either cyan, magenta, yellow, black, red, green or blue) was ink jet printed onto uncoated brown kraft liner paper (75#) using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Table 9.

TABLE 9

| UNCOATED KRAFT LINER | ID | Rod | Coat Wt g/m$^2$ | Pigment | Binder | Ratio | Substrate | AVG OD | GAMUT |
|---|---|---|---|---|---|---|---|---|---|
| | | | 0.00 | n/a | n/a | n/a | Kraft | 0.96 | 561 |

| | Cyan | | | Magenta | | | Yellow | | | Black | | |
|---|---|---|---|---|---|---|---|---|---|---|---|---|
| OD | 0.735 | 0.713 | 0.711 | 0.834 | 0.847 | 0.867 | 1.007 | 1.005 | 1.028 | 1.274 | 1.275 | 1.264 |
| L* | 52.16 | 52.48 | 52.67 | 49.54 | 48.96 | 48.11 | 56.94 | 57.52 | 56.78 | 26.55 | 26.48 | 26.90 |
| A* | −5.32 | −3.95 | −4.20 | 17.90 | 17.61 | 17.61 | 9.74 | 9.94 | 9.65 | 0.00 | −0.03 | 0.02 |
| B* | −3.38 | −3.15 | −3.16 | 1.73 | 1.81 | 2.58 | 29.00 | 29.79 | 29.92 | −1.51 | −1.47 | −1.46 |

| | Red | | | Green | | | Blue | | |
|---|---|---|---|---|---|---|---|---|---|
| OD | n/a | n/a | n/a | n/a | n/a | n/a | n/a | n/a | n/a |
| L* | 44.49 | 44.05 | 44.49 | 50.82 | 51.02 | 49.72 | 43.99 | 44.79 | 43.44 |
| A* | 20.56 | 20.69 | 20.39 | −4.28 | −4.30 | −4.08 | −3.47 | −3.47 | −3.79 |
| B* | 15.39 | 15.30 | 14.97 | 11.93 | 11.82 | 10.66 | −6.39 | −6.84 | −7.31 |

Figure 2:
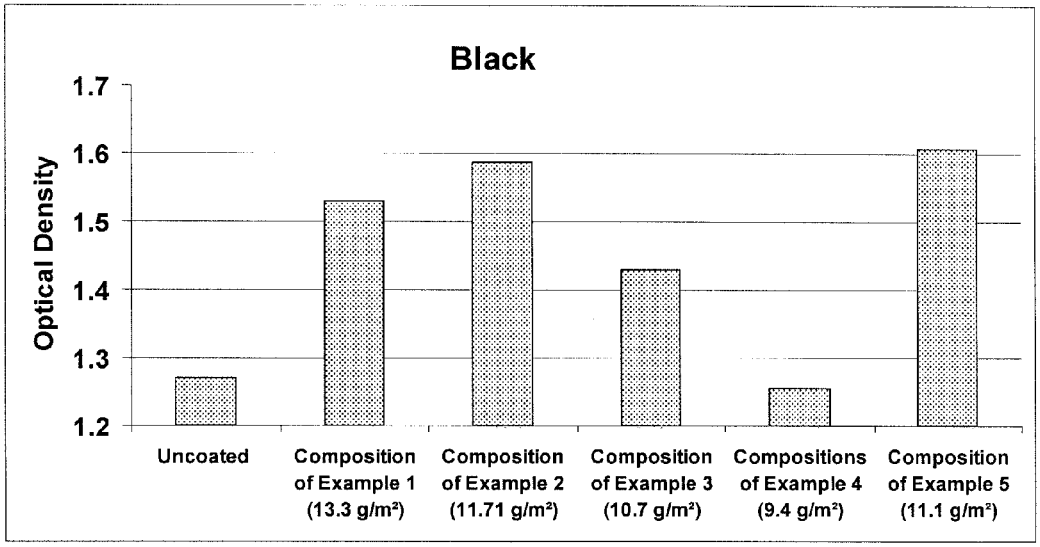
FIGS. 2A and 2B are graphical representations depicting the optical density of black and colored inks printed onto kraft paper coated with various compositions comprising silica.
Figure 2:
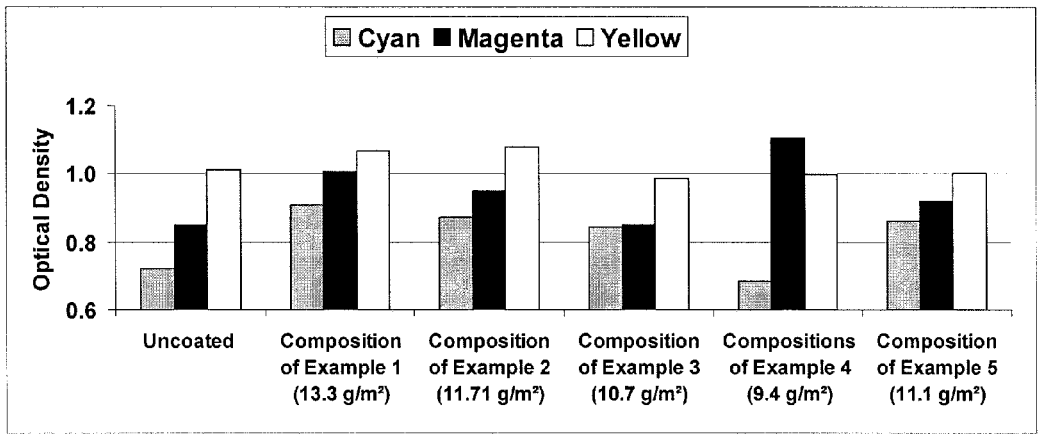
Figure 3:
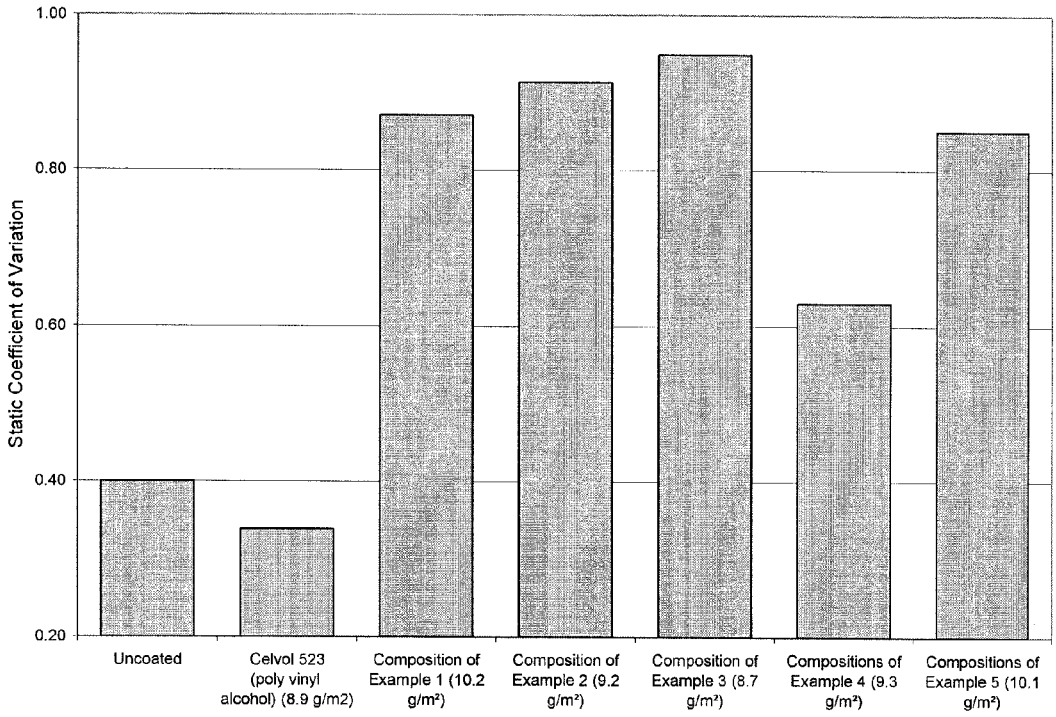
FIG. 3 is a graphical representation depicting the static coefficient of variation for paper coated with various compositions comprising silica.

The optical density averages for black, cyan, magenta and yellow inks printed onto uncoated paper (uncoated kraft liner) are also represented graphically in FIGS. 2 (A and B).

EXAMPLE 12

Images Printed on Kraft Liner Paper Coated with Polyvinyl Alcohol

CELVOL® 523 (polyvinyl alcohol) was used to coat brown kraft liner paper (75#). Ink (either cyan, magenta, yellow, black, red, green or blue) was ink jet printed onto the paper coated with CELVOL® 523 using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Table 10.

TABLE 10

| KRAFT LINER COATED WITH CELVOL ® 523 | Coat Wt g/m$^2$ | Pigment | Binder | Ratio | Substrate | AVG OD | GAMUT |
|---|---|---|---|---|---|---|---|
| | 0.00 | None | CV 523 | n/a | Kraft | 1.09 | 521 |

| | Cyan | | | Magenta | | | Yellow | | | Black | | |
|---|---|---|---|---|---|---|---|---|---|---|---|---|
| OD | 0.772 | 0.772 | 0.766 | 1.180 | 1.195 | 1.160 | 1.075 | 1.084 | 1.078 | 1.341 | 1.368 | 1.342 |
| L* | 48.21 | 48.46 | 48.61 | 35.97 | 35.16 | 36.80 | 55.36 | 53.69 | 54.29 | 24.48 | 24.00 | 24.50 |
| A* | −2.14 | −2.45 | −2.27 | 19.01 | 17.68 | 19.10 | 9.99 | 9.92 | 9.87 | 0.06 | −0.01 | −0.07 |
| B* | −1.80 | −2.16 | −2.07 | 2.38 | 1.45 | 1.62 | 30.06 | 28.01 | 28.45 | −1.80 | −1.86 | −1.82 |

| | Red | | | Green | | | Blue | | |
|---|---|---|---|---|---|---|---|---|---|
| OD | N/A | N/A | N/A | N/A | N/A | N/A | N/A | N/A | N/A |
| L* | 29.65 | 29.37 | 29.72 | 43.70 | 44.09 | 44.35 | 31.65 | 31.67 | 31.35 |
| A* | 22.27 | 22.10 | 21.09 | −3.51 | −3.74 | −3.56 | −1.65 | −1.71 | −1.72 |
| B* | 9.88 | 10.25 | 8.98 | 10.51 | 10.49 | 10.79 | −6.68 | −6.66 | −5.82 |

EXAMPLE 13

Images Printed on Kraft Liner Paper Coated with Composition of Example 1

Ink (either cyan, magenta, yellow, black, red, green or blue) was ink jet printed onto brown kraft liner paper (75#) coated with the composition of Example 1 at a coat weight of either 8.00 or 11.71 g silica per $m^2$ paper using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Tables 11 and 12.

TABLE 11

KRAFT LINER COATED WITH W7622 AND Coat Wt CELVOL ® 523

| Coat Wt $g/m^2$ | Pigment | Binder | Ratio | Substrate | AVG OD | GAMUT |
|---|---|---|---|---|---|---|
| 8.6 | W7622 | CV 523 | 6.67 | Kraft | 1.13 | 2128 |

| | Cyan | | | Magenta | | | Yellow | | | Black | | |
|---|---|---|---|---|---|---|---|---|---|---|---|---|
| OD | 0.879 | 0.880 | 0.867 | 1.012 | 0.994 | 1.014 | 1.079 | 1.094 | 1.082 | 1.594 | 1.538 | 1.508 |
| L* | 58.68 | 58.38 | 59.90 | 44.23 | 44.67 | 43.86 | 65.91 | 66.40 | 64.93 | 16.09 | 17.74 | 18.66 |
| A* | −20.11 | −19.96 | −20.38 | 25.02 | 24.20 | 24.33 | 8.83 | 8.83 | 8.77 | −1.13 | −0.62 | −0.30 |
| B* | −19.49 | −18.96 | −21.12 | −0.55 | −0.91 | −0.47 | 45.82 | 47.21 | 44.61 | −2.76 | −2.37 | −2.18 |

| | Red | | | Green | | | Blue | | |
|---|---|---|---|---|---|---|---|---|---|
| OD | N/A | N/A | N/A | N/A | N/A | N/A | N/A | N/A | N/A |
| L* | 37.10 | 35.40 | 37.77 | 50.48 | 49.45 | 51.17 | 38.28 | 36.79 | 37.22 |
| A* | 30.85 | 27.73 | 30.53 | −13.63 | −15.46 | −16.02 | −5.87 | −5.82 | −5.25 |
| B* | 19.03 | 16.12 | 18.51 | 8.35 | 8.23 | 8.19 | −28.91 | −26.50 | −31.97 |

TABLE 12

KRAFT LINER COATED WITH W7622 AND CELVOL ® 523

| Coat Wt $g/m^2$ | Pigment | Binder | Ratio | Substrate | AVG OD | GAMUT |
|---|---|---|---|---|---|---|
| 13.3 | W7622 | CV 523 | 6.67 | Kraft | 1.13 | 2041 |

| | Cyan | | | Magenta | | | Yellow | | | Black | | |
|---|---|---|---|---|---|---|---|---|---|---|---|---|
| OD | 0.935 | 0.892 | 0.897 | 1.003 | 1.010 | 1.005 | 1.042 | 1.079 | 1.084 | 1.537 | 1.527 | 1.525 |
| L* | 55.17 | 57.48 | 57.59 | 43.88 | 43.75 | 44.23 | 66.49 | 65.94 | 65.93 | 17.82 | 18.08 | 18.21 |
| A* | −18.87 | −19.61 | −19.75 | 23.74 | 24.20 | 24.63 | 8.27 | 8.40 | 8.67 | −0.60 | −0.27 | −0.30 |
| B* | −18.56 | −18.53 | −19.42 | −0.98 | −0.92 | −0.82 | 44.74 | 45.83 | 46.10 | −2.37 | −2.24 | −2.31 |

| | Red | | | Green | | | Blue | | |
|---|---|---|---|---|---|---|---|---|---|
| OD | N/A | N/A | N/A | N/A | N/A | N/A | N/A | N/A | N/A |
| L* | 36.61 | 36.29 | 36.93 | 51.68 | 51.47 | 51.60 | 38.35 | 39.37 | 37.31 |
| A* | 30.22 | 30.68 | 30.23 | −15.53 | −15.38 | −15.93 | −5.31 | −6.44 | −5.28 |
| B* | 18.42 | 19.22 | 18.53 | 8.46 | 8.51 | 8.05 | −31.81 | 35.88 | −29.61 |

The optical density averages for black, cyan, magenta and yellow inks printed onto paper coated with 13.3 g/m$^2$ of the composition of Example 1 (W7622) are also represented graphically in FIGS. 2 (A and B).

EXAMPLE 14

Images Printed on Kraft Liner Paper Coated with Composition of Example 2

Ink (either cyan, magenta, yellow, black, red, green or blue) was ink jet printed onto brown kraft liner paper (75#) coated with the composition of Example 2 at a coat weight of either 8.00 or 11.71 g silica per m$^2$ paper using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Tables 13 and 14.

TABLE 13

KRAFT LINER COATED WITH W7520 AND CELVOL ® 523

| Coat Wt g/m$^2$ | Pigment | Binder | Ratio | Substrate | AVG OD | GAMUT |
|---|---|---|---|---|---|---|
| 8.00 | W7520 | CV 523 | 6.67 | Kraft | 1.13 | 1881 |

| | Cyan | | | Magenta | | | Yellow | | | Black | | |
|---|---|---|---|---|---|---|---|---|---|---|---|---|
| OD | 0.862 | 0.880 | 0.864 | 0.975 | 0.970 | 0.968 | 1.051 | 1.108 | 1.098 | 1.620 | 1.588 | 1.609 |
| L* | 56.31 | 56.19 | 57.28 | 44.48 | 45.27 | 45.46 | 65.30 | 66.19 | 66.10 | 15.24 | 16.39 | 15.72 |
| A* | −17.47 | −18.01 | −18.40 | 21.79 | 23.43 | 23.59 | 8.37 | 8.70 | 8.87 | −0.41 | −0.70 | −0.63 |
| B* | −14.85 | −16.06 | −16.52 | −1.08 | −0.81 | −0.69 | 43.49 | 47.71 | 47.10 | −2.52 | −2.51 | −2.58 |

| | Red | | | Green | | | Blue | | |
|---|---|---|---|---|---|---|---|---|---|
| OD | n/a | n/a | n/a | n/a | n/a | n/a | n/a | n/a | n/a |
| L* | 38.64 | 38.45 | 38.74 | 51.23 | 50.35 | 50.07 | 39.23 | 39.21 | 39.39 |
| A* | 29.81 | 30.39 | 29.33 | −13.93 | −14.41 | −11.79 | −7.19 | −7.10 | −7.41 |
| B* | 17.95 | 18.15 | 17.60 | 7.47 | 7.19 | 7.42 | −29.23 | −28.61 | −29.44 |

TABLE 14

KRAFT LINER COATED WITH W7520 AND CELVOL ® 523

| Coat Wt g/m$^2$ | Pigment | Binder | Ratio | Substrate | AVG OD | GAMUT |
|---|---|---|---|---|---|---|
| 11.71 | W7520 | CV 523 | 6.67 | Kraft | 1.12 | 2377 |

| | Cyan | | | Magenta | | | Yellow | | | Black | | |
|---|---|---|---|---|---|---|---|---|---|---|---|---|
| OD | 0.877 | 0.870 | 0.874 | 0.950 | 0.967 | 0.931 | 1.080 | 1.076 | 1.080 | 1.583 | 1.586 | 1.591 |
| L* | 59.45 | 59.92 | 59.83 | 46.50 | 45.90 | 47.53 | 68.08 | 68.81 | 67.39 | 16.52 | 16.41 | 16.23 |
| A* | −20.41 | −20.64 | −20.64 | 24.86 | 24.61 | 24.94 | 8.59 | 8.49 | 8.28 | −0.66 | −0.70 | −0.71 |
| B* | −21.07 | −21.08 | −21.46 | −2.61 | −2.17 | −2.54 | 48.67 | 49.48 | 47.83 | −2.51 | −2.53 | −2.75 |

| | Red | | | Green | | | Blue | | |
|---|---|---|---|---|---|---|---|---|---|
| OD | n/a | n/a | n/a | n/a | n/a | n/a | n/a | n/a | n/a |
| L* | 37.16 | 37.38 | 38.50 | 52.18 | 52.59 | 52.31 | 39.29 | 39.65 | 40.35 |
| A* | 29.41 | 31.71 | 31.02 | −16.86 | −17.52 | −16.91 | −6.97 | −7.09 | −6.97 |
| B* | 17.78 | 20.40 | 19.25 | 8.17 | 8.37 | 8.47 | −34.24 | −34.45 | −34.86 |

The optical density averages for black, cyan, magenta and yellow inks printed onto paper coated with 11.7 g/m$^2$ of the composition of Example 2 (W7520) are also represented graphically in FIGS. 2 (A and B).

EXAMPLE 15

Images Printed on Kraft Liner Paper Coated with Composition of Example 3

Ink (either cyan, magenta, yellow, black, red, green or blue) was ink jet printed onto brown kraft liner paper (75#) coated with the composition of Example 3, at a coat weight of either 8.5 or 10.7 g silica per m$^2$ paper, using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Tables 15 and 16.

TABLE 15

| KRAFT LINER COATED WITH W7515S AND CELVOL ® 523 | | | | | | | | | | | | |
|---|---|---|---|---|---|---|---|---|---|---|---|---|
| | | | | Coat Wt g/m$^2$ | | Pigment | Binder | Ratio | Substrate | | AVG OD | GAMUT |
| | | | | 8.5 | | W7515S | CV 523 | 6.67 | Kraft | | 1.05 | 2026 |
| | Cyan | | | | Magenta | | | Yellow | | | Black | |
| OD | 0.847 | 0.852 | 0.857 | 0.918 | 0.928 | 0.861 | 0.985 | 0.986 | 0.982 | 1.438 | 1.441 | 1.467 |
| L* | 58.33 | 60.10 | 58.18 | 54.74 | 45.98 | 49.11 | 68.31 | 67.37 | 68.03 | 20.87 | 20.80 | 20.03 |
| A* | −17.74 | −19.01 | −17.82 | 19.03 | 20.29 | 21.62 | 6.97 | 6.45 | 6.80 | −0.06 | −0.20 | −0.44 |
| B* | −19.65 | −23.47 | −20.37 | −6.25 | −4.68 | −8.51 | 43.74 | 42.42 | 43.16 | −2.00 | −1.97 | −2.13 |
| | Red | | | | Green | | | Blue | | | | |
| OD | N/A | N/A | N/A | N/A | N/A | N/A | N/A | N/A | N/A | | | |
| L* | 40.89 | 40.71 | 41.08 | 52.81 | 51.81 | 55.12 | 44.32 | 46.67 | 43.34 | | | |
| A* | 27.86 | 28.41 | 28.07 | −15.18 | −13.89 | −17.44 | −7.01 | −7.46 | −6.70 | | | |
| B* | 12.48 | 13.22 | 12.83 | 3.37 | 3.50 | 3.38 | −39.05 | −41.25 | −36.95 | | | |

TABLE 16

| KRAFT LINER COATED WITH W7515S AND CELVOL ® 523 | | | | | | | | | | | | |
|---|---|---|---|---|---|---|---|---|---|---|---|---|
| | | | | Coat Wt g/m$^2$ | | Pigment | Binder | Ratio | Substrate | | AVG OD | GAMUT |
| | | | | 10.7 | | W7515S | CV 523 | 6.67 | Kraft | | 1.03 | 2187 |
| | Cyan | | | | Magenta | | | Yellow | | | Black | |
| OD | 0.846 | 0.847 | 0.841 | 0.862 | 0.852 | 0.837 | 0.996 | 0.980 | 0.983 | 1.428 | 1.435 | 1.425 |
| L* | 60.64 | 60.71 | 60.94 | 48.59 | 49.35 | 50.04 | 67.44 | 68.37 | 68.33 | 21.29 | 21.05 | 21.39 |
| A* | −19.07 | −19.24 | −19.19 | 20.55 | 21.42 | 21.51 | 7.18 | 6.69 | 6.94 | −0.17 | −0.20 | −0.20 |
| B* | −24.03 | −24.20 | −24.12 | −8.90 | −8.56 | −9.26 | 43.28 | 43.67 | 43.85 | −1.91 | −1.97 | −1.95 |
| | Red | | | | Green | | | Blue | | | | |
| OD | N/A | N/A | N/A | N/A | N/A | N/A | N/A | N/A | N/A | | | |
| L* | 41.80 | 41.43 | 42.88 | 55.24 | 54.27 | 52.47 | 44.45 | 44.39 | 43.80 | | | |
| A* | 28.78 | 28.11 | 28.78 | −17.36 | −17.32 | −15.25 | −7.01 | −6.83 | −6.97 | | | |
| B* | 13.19 | 12.08 | 12.50 | 3.90 | 2.98 | 3.58 | −39.88 | −38.81 | −39.09 | | | |

The optical density averages for black, cyan, magenta and yellow inks printed onto paper coated with 10.7 g/m$^2$ of the composition of Example 3 (W7215 S) are also represented graphically in FIGS. 2 (A and B).

EXAMPLE 16

Images Printed on Kraft Liner Paper Coated with Compositions of Example 4

Ink (either cyan, magenta, yellow, black, red, green or blue) was ink jet printed onto brown kraft liner paper (75#) coated with the compositions of Example 4 (IJ935, NYACOL™ 1430, BINDZIL™ 30/60, LUDOX™ HS40 and LUDOX™ SM30) using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, and black, inks and the L*, a* and b* values were measured in triplicate for the red, green and blue inks. The results are presented in Tables 17-21.

TABLE 17

KRAFT LINER COATED WITH IJ 935 AND CELVOL ® 523

| Coat Wt g/m$^2$ | Pigment | Binder | Ratio | Substrate | AVG OD | GAMUT |
|---|---|---|---|---|---|---|
| 6.09 | IJ 935 | CV 523 | 6.67 | Kraft | 1.17 | 734 |

| | Cyan | | | Magenta | | | Yellow | | | Black | | |
|---|---|---|---|---|---|---|---|---|---|---|---|---|
| OD | 0.801 | 0.772 | 0.800 | 1.223 | 1.201 | 1.214 | 1.243 | 1.238 | 1.274 | 1.539 | 1.390 | 1.362 |
| L* | 50.22 | 51.11 | 48.98 | 34.88 | 35.77 | 35.07 | 53.62 | 54.43 | 52.11 | 17.49 | 22.58 | 23.44 |
| A* | −7.24 | −6.51 | −5.48 | 20.64 | 20.77 | 20.22 | 10.93 | 11.37 | 11.03 | −0.44 | 0.04 | −0.15 |
| B* | −4.36 | −4.08 | −3.34 | 3.20 | 3.44 | 2.69 | 36.36 | 37.26 | 35.59 | −2.57 | −1.79 | −1.82 |

| | Red | | | Green | | | Blue | | |
|---|---|---|---|---|---|---|---|---|---|
| OD | N/A | N/A | N/A | N/A | N/A | N/A | N/A | N/A | N/A |
| L* | 29.22 | 30.12 | 30.70 | 42.84 | 44.36 | 43.78 | 28.39 | 30.20 | 30.52 |
| A* | 21.40 | 23.03 | 21.57 | −4.64 | −5.01 | −4.74 | −2.69 | −2.25 | −2.36 |
| B* | 12.84 | 14.01 | 13.45 | 13.60 | 14.25 | 13.73 | −6.50 | −7.16 | −7.36 |

TABLE 18

KRAFT LINER COATED WITH NYACOL ™ 1430 AND CELVOL ® 523

| Coat Wt g/m$^2$ | Pigment | Binder | Ratio | Substrate | AVG OD | GAMUT |
|---|---|---|---|---|---|---|
| 9.9 | N 1430 | CV 523 | 6.67 | Kraft | 0.96 | 715 |

| | Cyan | | | Magenta | | | Yellow | | | Black | | |
|---|---|---|---|---|---|---|---|---|---|---|---|---|
| OD | 0.638 | 0.637 | 0.628 | 1.068 | 1.088 | 1.092 | 0.975 | 1.002 | 0.955 | 1.227 | 1.249 | 1.223 |
| L* | 54.92 | 54.77 | 55.43 | 39.71 | 38.98 | 38.84 | 58.25 | 57.30 | 59.54 | 28.27 | 27.51 | 28.46 |
| A* | −1.49 | −1.29 | −1.38 | 18.28 | 18.59 | 18.58 | 10.23 | 10.24 | 10.31 | 0.26 | 0.17 | 0.26 |
| B* | −2.09 | −1.76 | −2.38 | 0.44 | 0.55 | 0.54 | 28.82 | 29.14 | 29.75 | −1.15 | −1.26 | −1.37 |

| | Red | | | Green | | | Blue | | |
|---|---|---|---|---|---|---|---|---|---|
| OD | N/A | N/A | N/A | N/A | N/A | N/A | N/A | N/A | N/A |
| L* | 32.49 | 33.10 | 32.39 | 50.45 | 51.22 | 50.07 | 37.05 | 37.24 | 35.99 |
| A* | 22.04 | 22.32 | 22.19 | −3.08 | −3.31 | −3.40 | −0.81 | −0.73 | −1.01 |
| B* | 12.33 | 13.02 | 12.29 | 15.39 | 15.48 | 14.60 | −6.52 | −7.20 | −6.57 |

TABLE 19

| KRAFT LINER COATED WITH BINDZIL ™ 30/60 AND CELVOL ® 523 | | | | | | | | | | | | |
|---|---|---|---|---|---|---|---|---|---|---|---|---|
| | | | | Coat Wt g/m$^2$ | | Pigment | Binder | Ratio | Substrate | | AVG OD | GAMUT |
| | | | | 12.5 | | BZ 30/60 | CV 523 | 6.67 | Kraft | | 0.98 | 576 |
| | Cyan | | | Magenta | | | Yellow | | | Black | | |
| OD | 0.667 | 0.643 | 0.667 | 1.124 | 1.079 | 1.076 | 0.921 | 0.949 | 0.927 | 1.158 | 1.129 | 1.169 |
| L* | 55.14 | 56.48 | 55.77 | 38.27 | 40.31 | 40.03 | 58.49 | 60.74 | 60.67 | 31.12 | 32.28 | 30.69 |
| A* | −4.15 | −4.24 | −5.08 | 20.42 | 21.26 | 20.37 | 9.62 | 10.84 | 10.33 | 0.44 | 0.48 | 0.40 |
| B* | −3.94 | −3.98 | −4.33 | 0.60 | 0.69 | 0.08 | 25.90 | 31.06 | 29.40 | −1.11 | −0.80 | −1.03 |
| | Red | | | Green | | | Blue | | | | | |
| OD | N/A | N/A | N/A | N/A | N/A | N/A | N/A | N/A | N/A | | | |
| L* | 29.31 | 33.69 | 32.18 | 50.47 | 50.45 | 51.26 | 36.60 | 36.77 | 35.82 | | | |
| A* | 20.77 | 24.80 | 25.83 | −4.48 | −4.66 | −5.05 | −0.99 | −0.83 | −0.92 | | | |
| B* | 9.06 | 12.96 | 14.01 | 11.15 | 13.09 | 11.57 | −12.10 | −11.08 | −12.95 | | | |

TABLE 20

| KRAFT LINER COATED WITH LUDOX ™ SM30 AND CELVOL ® 523 | | | | | | | | | | | | |
|---|---|---|---|---|---|---|---|---|---|---|---|---|
| | | | | Coat Wt g/m$^2$ | | Pigment | Binder | Ratio | Substrate | | AVG OD | GAMUT |
| | | | | 10.3 | | SM30 | CV 523 | 6.67 | Kraft | | 1.05 | 667 |
| | Cyan | | | Magenta | | | Yellow | | | Black | | |
| OD | 0.734 | 0.758 | 0.748 | 1.108 | 1.102 | 1.111 | 1.026 | 1.007 | 1.025 | 1.328 | 1.285 | 1.330 |
| L* | 53.49 | 52.25 | 51.85 | 37.53 | 38.78 | 38.11 | 55.81 | 55.66 | 55.27 | 24.78 | 26.50 | 24.79 |
| A* | −7.01 | −7.02 | −5.72 | 16.84 | 19.83 | 18.76 | 9.47 | 8.92 | 9.02 | 0.08 | 0.14 | 0.08 |
| B* | −4.98 | −4.86 | −4.29 | −0.42 | 0.11 | 0.17 | 28.00 | 26.27 | 27.03 | −1.63 | −1.28 | −1.61 |
| | Red | | | Green | | | Blue | | | | | |
| OD | N/A | N/A | N/A | N/A | N/A | N/A | N/A | N/A | N/A | | | |
| L* | 32.32 | 32.78 | 29.09 | 45.96 | 47.09 | 46.48 | 34.93 | 34.60 | 36.94 | | | |
| A* | 23.76 | 22.68 | 22.79 | −4.50 | −4.80 | −4.70 | −1.73 | −1.56 | −1.31 | | | |
| B* | 11.85 | 10.83 | 10.71 | 10.77 | 11.63 | 11.34 | −10.69 | −11.35 | −12.14 | | | |

TABLE 21

| KRAFT LINER COATED WITH LUDOX ™ HS40 AND CELVOL ® 523 | | | | | | | | | | | | |
|---|---|---|---|---|---|---|---|---|---|---|---|---|
| | | | | Coat Wt g/m$^2$ | | Pigment | Binder | Ratio | Substrate | | AVG OD | GAMUT |
| | | | | 8.08 | | HS40 | CV 523 | 6.67 | Kraft | | 1.00 | 486 |
| | Cyan | | | Magenta | | | Yellow | | | Black | | |
| OD | 0.667 | 0.664 | 0.681 | 1.122 | 1.124 | 1.130 | 0.975 | 1.007 | 1.005 | 1.259 | 1.206 | 1.188 |
| L* | 52.82 | 53.19 | 52.31 | 37.84 | 37.58 | 37.68 | 54.91 | 55.84 | 55.41 | 27.15 | 28.99 | 29.69 |
| A* | −1.02 | −1.27 | −1.24 | 18.32 | 18.13 | 18.74 | 8.53 | 10.15 | 9.74 | 0.13 | 0.31 | 0.39 |
| B* | −0.54 | −1.16 | −0.98 | 1.99 | 1.75 | 2.23 | 23.89 | 27.40 | 26.61 | −1.25 | −1.18 | −1.11 |
| | Red | | | Green | | | Blue | | | | | |
| OD | N/A | N/A | N/A | N/A | N/A | N/A | N/A | N/A | N/A | | | |
| L* | 32.43 | 32.42 | 33.20 | 47.73 | 48.64 | 47.83 | 35.60 | 35.95 | 34.61 | | | |
| A* | 21.44 | 21.54 | 21.09 | −3.24 | −3.28 | −3.13 | −1.39 | −1.41 | −1.63 | | | |
| B* | 12.61 | 12.68 | 12.02 | 14.11 | 14.36 | 13.85 | −5.85 | −6.33 | −5.68 | | | |

The optical density averages for black, cyan, magenta and yellow inks printed onto paper coated with 9.4 g/m$^2$ of colloidal silica (values averaged for LUDOX™ HS40, NYACOL™ 1430, and LUDOX™ SM30) (colloidal) are also represented graphically in FIGS. 2 (A and B).

EXAMPLE 17

Images Printed on Kraft Liner Paper Coated with Composition of Example 5

Ink (either cyan, magenta, yellow, black, red, green or blue) was ink jet printed onto brown kraft liner paper (75#) coated with the composition of Example 5, at a coat weight of 11.1 g silica per m$^2$ paper, using an Epson Stylus Photo R200 printer and using the following settings: Glossy Photo/Best Photo/Enhance/Unidirectional.

The optical density (OD), L*, a* and b* values were measured in triplicate for the cyan, magenta, yellow, black, red, green and blue inks. The results are presented in Table 22.

TABLE 22

| KRAFT LINER COATED WITH SIPERNAT ® 22 S AND CELVOL ® 523 | Coat Wt g/m$^2$ | Pigment | Binder | Ratio | Substrate | AVG OD | GAMUT |
|---|---|---|---|---|---|---|---|
| | 11.1 | 22 S | CV 523 | 6.67 | Kraft | 1.1 | 2349 |

| | Cyan | | | Magenta | | | Yellow | | | Black | | |
|---|---|---|---|---|---|---|---|---|---|---|---|---|
| OD | 0.896 | 0.842 | 0.829 | 0.933 | 0.918 | 0.914 | 1.020 | 1.014 | 0.979 | 1.607 | 1.609 | 1.606 |
| L* | 59.69 | 61.66 | 62.08 | 47.11 | 47.41 | 48.05 | 65.55 | 66.08 | 68.41 | 15.66 | 15.52 | 15.68 |
| A* | −19.50 | −20.18 | −19.70 | 24.86 | 23.65 | 24.86 | 9.54 | 9.16 | 9.10 | −0.71 | −0.73 | −0.74 |
| B* | −21.94 | −24.10 | −24.72 | −5.68 | −6.13 | −6.35 | 41.93 | 42.29 | 43.55 | −2.61 | −2.67 | −2.62 |

| | Red | | | Green | | | Blue | | |
|---|---|---|---|---|---|---|---|---|---|
| OD | 1.208 | 1.167 | 1.173 | 0.801 | 0.805 | 0.796 | 1.148 | 1.132 | 1.162 |
| L* | 41.02 | 42.09 | 41.81 | 54.67 | 54.78 | 55.04 | 43.11 | 43.86 | 43.06 |
| A* | 33.20 | 32.52 | 31.95 | −16.44 | −16.94 | −16.70 | −6.50 | −6.34 | −6.21 |
| B* | 16.82 | 14.97 | 14.85 | 5.33 | 5.55 | 6.09 | −37.87 | −38.74 | −40.01 |

EXAMPLE 18

Color Gamut of Kraft Paper Coated with Compositions of Examples 1-5

Figure 4:
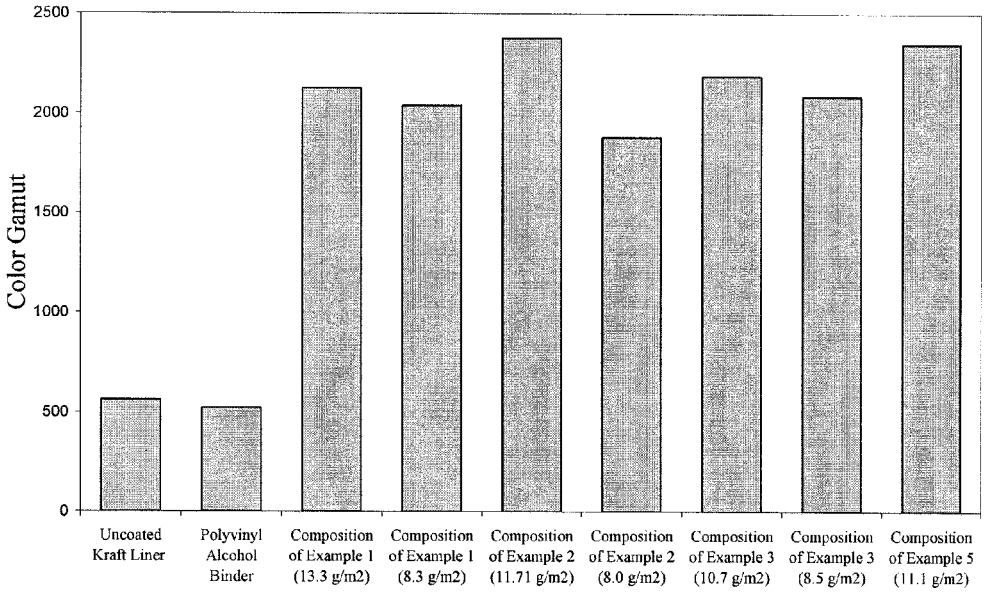
FIGS. 4A and 4B are graphical representations depicting the color gamut of paper coated with various compositions comprising silica.
Figure 4:
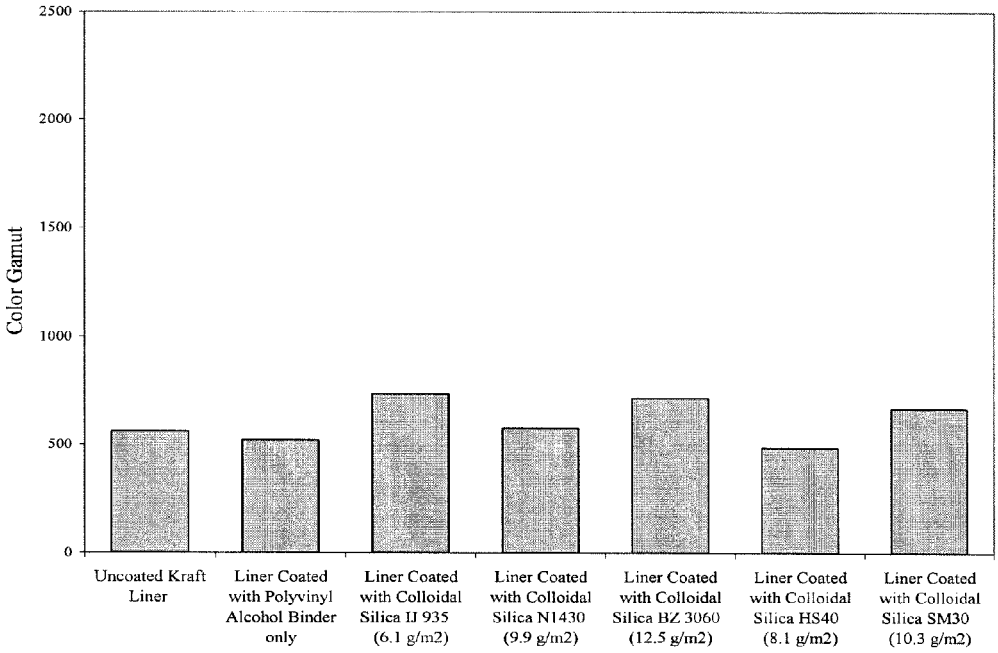

The color gamut was measured for uncoated kraft liners, kraft liners coated only with polyvinyl alcohol and kraft liners coated with the compositions of Examples 1-5, as described in Examples 6-10. Values for the color gamut are shown in Tables 9-22. The results are shown in FIGS. 4 (A and B). Each of the coating compositions comprising fumed silica or precipitated silica substantially increased the color gamut of the kraft liner paper by approximately four-fold when compared with uncoated kraft liner paper, or kraft liner paper coated with polyvinyl alcohol (FIG. 4A). In contrast, the coating compositions comprising colloidal silica did not increase the color gamut of the kraft liner paper, or increased the color gamut only slightly when compared with uncoated kraft liner paper, or kraft liner paper coated with polyvinyl alcohol. (FIG. 4B).

EXAMPLE 19

Coefficient of Friction of Kraft Paper Coated with Polyvinyl Alcohol and Silica

The pick up (the amount of coating dried onto the paper over a defined area) and coefficient of friction for brown kraft paper coated with compositions comprising silica was measured. Kraft liner paper (75#) (obtained from Uline) was coated using a #5 wire wound rod. The sheet was first blow dried, then dried under restraint. The pick-up was calculated gravimetrically when the paper was completely dry. The samples were mounted on the Coefficient of Friction Tester (TMI model 32-25) and tested per TAPPI method T815 om-01 with a 200 g sled with an area of 2.5×2.5".

The pick-up and coefficient of friction for paper coated with one of three different types of polyvinyl alcohol (CELVOL® 523, CELVOL® 603 or CELVOL® 08-125) are shown in Table 23. The pick-up and coefficient of friction for paper coated with CELVOL® 523 and one of the following fumed silicas: W7330, W7520, W7622, W7215S, W1226; precipitated silica SIPERNAT® 22 S (22 S); or one of the following colloidal silicas: IJ935, N1430, BZ 30/60, HS40, SM30 are shown in Table 24. The numbers in parentheses in Table 23 reflect the ratio of silica to polyvinyl alcohol in each composition. The average for three separate samples, each measured five times is provided in Tables 23 and 24. For each coating, the standard deviation of the measurements fell between 0.02 and 0.04 (2 d.p.) for the coefficient of friction and between 0.06 and 2.98 (2 d.p.) for the pick up.

Visual inspection of paper coated with the compositions recited in Table 24 revealed that each fumed silica or precipitated silica composition coated the paper with an opaque and uniform layer, making the paper appear whiter and brighter. In contrast, papers coated with each of the colloidal silicas essentially remained translucent and were comparable to the paper coated only with polyvinyl alcohol.

TABLE 23

| | Pick-Up (g/m$^2$) | Coefficient of Friction |
|---|---|---|
| No coating | | 0.4 |
| Celvol 523 | 8.88 | 0.34 |
| Celvol 603 | 6.13 | 0.52 |
| Celvol 08-125 | 5.19 | 0.38 |

TABLE 24

| CELVOL ® 523 plus: | Pick-Up ($g/m^2$) | Coefficient of Friction |
|---|---|---|
| W7330 (6.67:1) | 10.59 | 0.94 |
| W7330 (5.00:1) | 10.76 | 0.93 |
| W7330 (4.00:1) | 11.21 | 0.88 |
| W7330 (3.33:1) | 10.87 | 0.86 |
| W7520 (6.67:1) | 9.18 | 0.91 |
| W7520 (5.00:1) | 9.15 | 0.92 |
| W7520 (4.00:1) | 9.30 | 0.91 |
| W7520 (3.33:1) | 9.38 | 0.90 |
| W7622 (6.67:1) | 10.20 | 0.87 |
| W7622 (5.00:1) | 12.30 | 0.84 |
| W7622 (4.00:1) | 10.73 | 0.84 |
| W7622 (3.33:1) | 11.34 | 0.84 |
| W7215S (6.67:1) | 8.67 | 0.95 |
| W7215S (5.00:1) | 7.59 | 0.94 |
| W7215S (4.00:1) | 7.14 | 0.94 |
| W7215S (3.33:1) | 6.57 | 0.97 |
| W1226 (6.67:1) | 9.10 | 0.96 |
| W1226 (5.00:1) | 10.11 | 0.93 |
| W1226 (4.00:1) | 9.92 | 0.92 |
| W1226 (3.33:1) | 9.72 | 0.89 |
| 22S (6.67:1) | 10.11 | 0.85 |
| IJ935 (6.67:1) | 13.88 | 0.85 |
| N1430 (6.67:1) | 19.66 | 0.82 |
| N1430 (6.67:1) | 9.48 | 0.68 |
| BZ 30/60 (6.67:1) | 17.44 | 0.77 |
| HS40 (6.67:1) | 13.89 | 0.79 |
| HS40 (6.67:1) | 8.59 | 0.66 |
| SM30 (6.67:1) | 16.45 | 0.78 |
| SM30 (6.67:1) | 9.68 | 0.56 |

All patents, publications and references cited herein are hereby fully incorporated by reference. In case of conflict between the present disclosure and incorporated patents, publications and references, the present disclosure should control.

What is claimed is:

1. A coated substrate comprising a colored paper having a GE brightness of less than about 90% coated with an opaque coating comprising precipitated silica or fumed silica, polyvinyl alcohol and poly(diallyl dimethyl ammonium chloride).

2. The coated substrate of claim 1, wherein the coating increases the L* whiteness of the colored paper by at least about 2.

3. The coated substrate of claim 1, wherein the coating reduces the b* value of the colored paper by at least about 2.

4. The coated substrate of claim 1, wherein the coating comprises a silica to polyvinyl alcohol ratio of at least about 0.25:1.

5. The coated substrate of claim 1, wherein the colored paper comprises brown Kraft paper.

6. The coated substrate of claim 1, wherein the colored paper has a GE brightness of less than about 75%.

7. The coated substrate of claim 1, wherein the colored paper comprises unbleached cellulose fibers.

8. The coated substrate of claim 1, wherein the coating has a coat weight of less than about 15 g silica per $m^2$ substrate.

9. The coated substrate of claim 1, wherein the coating increases the coefficient of friction of the substrate by at least about 0.2.

10. The coated substrate of claim 1, wherein the coated substrate is incorporated into a packaging material selected from a box, sack and bag.

11. The coated substrate of claim 1, further comprising an image printed on the coated substrate.

12. The coated substrate of claim 11, wherein the image is formed by an inkjet printer.

13. The coated substrate of claim 11, wherein the image shows at least one of a reduction in bleeding of at least about 5 microns, a reduction in wicking of at least about 5 microns, a reduction in line raggedness of at least about 2 microns, an increase in optical density of at least about 0.05, and a combination thereof compared to the same image printed on the same colored paper without the coating.

14. The coated substrate of claim 11, wherein the image shows an increased color gamut of at least about 50% compared to the same image printed on the same colored paper without the coating.

15. The coated substrate of claim 1, wherein the precipitated silica or the fumed silica, or a combination thereof, is present in an amount sufficient to increase the L* whiteness of the colored paper by at least about 2.

16. A coated substrate comprising a colored paper having a GE brightness of less than about 90% coated with an opaque coating comprising a fumed metal oxide, the fumed metal oxide being present in an amount sufficient to render the coating opaque.

17. The coated substrate of claim 16, wherein the coating increases the L* whiteness of the colored paper by at least about 2.

18. The coated substrate of claim 16, wherein the coating reduces the b* value of the colored paper by at least about 2.

19. The coated substrate of claim 16, wherein the colored paper comprises brown Kraft paper.

20. The coated substrate of claim 16, wherein the coated substrate is incorporated into a packaging material selected from a box, sack and bag.

21. The coated substrate of claim 16, wherein the coating increases the coefficient of friction of the substrate by at least about 0.2.

22. The coated substrate of claim 16, further comprising an image printed on the coated substrate.

23. The coated substrate of claim 22, wherein the image shows a property selected from a reduction in bleeding of at least about 5 microns, a reduction in wicking of at least about 5 microns, a reduction in line raggedness of at least about 2 microns, an increase in optical density of at least about 0.05, an increase in color gamut of at least about 50%, and combinations thereof compared to the same image printed on the same colored paper without the coating.

24. A method of making a coated substrate comprising applying a composition comprising a dispersion comprising a fumed metal oxide to a colored paper having a GE brightness of less than about 90%, the fumed metal oxide being present in an amount sufficient to render the coating opaque.

25. The method of claim 24, wherein the composition further comprises a binder.

26. The method of claim 24, wherein the composition comprises an aqueous dispersion of fumed silica.

27. The method of claim 24, wherein the colored paper is brown Kraft paper.

28. The method of claim 24, wherein the composition increases the L* whiteness of the colored paper by at least about 2.

29. The method of claim 25, further comprising adding the binder to the dispersion comprising a fumed metal oxide to produce the composition.

30. A coated substrate comprising a colored paper having a GE brightness of less than about 90% coated with an opaque coating comprising polyvinyl alcohol, poly(diallyl dimethyl ammonium chloride) and at least one of precipitated silica and fumed silica present in an amount sufficient to confer opacity to the coating.

31. The coated substrate of claim 30, wherein the precipitated silica or the fumed silica, or a combination thereof, is present in an amount sufficient to increase the L* whiteness of the colored paper by at least about 2.

* * * * *